US005381868A

United States Patent [19]

Schock

[11] Patent Number: 5,381,868

[45] Date of Patent: Jan. 17, 1995

[54] SEALED BEARING ROLLER REAMER

[75] Inventor: William H. Schock, Lafayette, La.

[73] Assignee: Triumph*LOR Inc, Lafayette, La.

[21] Appl. No.: 252,387

[22] Filed: Jun. 1, 1994

Related U.S. Application Data

[63] Continuation of Ser. No. 134,268, Oct. 8, 1993, abandoned.

[51] Int. Cl.[6] ..... E21B 10/20; E21B 10/22; E21B 10/30

[52] U.S. Cl. ..... 175/346; 175/325.3; 175/347; 175/371

[58] Field of Search ..... 175/345, 346, 347, 325.3, 175/363, 366, 367, 371, 372; 384/92, 226, 435

[56] References Cited

U.S. PATENT DOCUMENTS 1,139,529 5/1915 Hughes .
1,294,106 2/1919 Humason .
1,306,371 6/1919 Culmore .
1,388,424 8/1921 George .
1,487,319 3/1924 Duda .
1,518,492 12/1924 Duda .
1,813,160 7/1931 Hamer .
1,848,404 3/1932 Abegg .
1,904,415 12/1933 Harrington et al. .
1,906,427 5/1933 Sievers et al. .
1,909,128 5/1933 Scott et al. .
1,945,937 2/1934 Giesey .
1,971,561 8/1934 Hammer .
1,988,023 1/1935 Spengler .
2,029,770 2/1936 Grant .
2,071,611 2/1937 Catland .
2,084,430 6/1937 Catland .
2,100,621 11/1937 Abegg .
2,100,892 11/1937 Abegg .
2,110,582 3/1938 Smith .
2,126,146 8/1938 Smith .
2,128,416 8/1938 Howard et al. .
2,134,095 10/1938 Abegg .
2,138,007 11/1938 Howard et al. .
2,156,444 5/1939 Zublin .
2,187,037 1/1940 Kirkpatrick .
2,189,029 2/1940 Harrington .
2,189,030 2/1940 Harrington .
2,189,031 2/1940 Harrington .
2,189,032 2/1940 Carleton .
2,189,033 2/1940 Book et al. .
2,189,034 2/1940 Harrington .
2,189,035 2/1940 Squires .
2,189,036 2/1940 Jones .
2,189,037 2/1940 Harrington .
2,189,038 2/1940 Jones .
2,189,039 2/1940 Childs .
2,189,040 2/1940 Jones .
2,190,350 2/1940 Catland .
2,199,693 5/1940 Catland .
2,218,743 10/1940 Catland .
2,234,219 3/1941 Anderson .
2,272,405 2/1942 Grant et al. .
2,306,492 12/1942 Noble .
2,339,161 1/1944 Fermier .
2,498,756 2/1950 Harris .
2,499,916 3/1950 Harris .
2,587,231 2/1952 Schierding .
2,695,771 11/1954 Salvatori et al. .
2,698,738 1/1955 Turner .
2,814,465 11/1957 Green .
2,834,579 5/1958 Emanuel .
2,872,159 2/1959 Autry .
3,007,751 11/1961 Eenink .
3,029,881 4/1962 Swart .

(List continued on next page.)

*Primary Examiner*—Stephen J. Novosad
*Attorney, Agent, or Firm*—Pravel, Hewitt, Kimball & Krieger

[57] ABSTRACT

The roller reamer drilling tool includes an elongated body having a fluid circulation bore. A plurality of roller reamer units are mounted circumferentially about the body and are capable of being installed as units within a series of pockets machined within the body. The pockets include a central pocket to receive the roller reamer, a lower bearing block pocket and an upper bearing block pocket which has a width greater than the width of the roller so that the roller can be installed through the upper bearing block pocket, which allows the installation of the roller, shaft and upper bearing block as a unit.

7 Claims, 2 Drawing Sheets

U.S. PATENT DOCUMENTS 3,048,230 8/1962 Angel .
3,054,466 9/1962 Wagnon et al. .
3,075,781 1/1963 Atkinson et al. .
3,230,019 1/1966 Kotch et al. .
3,230,020 1/1966 Gilbert et al. .
3,251,634 5/1966 Dareing .
3,303,898 2/1967 Bercaru .
3,303,900 2/1967 Kloesel, Jr. et al. .
3,627,068 12/1971 Wagnon et al. .
3,659,663 5/1972 Dysart .
3,719,241 3/1973 Bell .
3,721,306 3/1973 Sartor .
3,735,826 5/1973 Constantinescu et al. .
3,739,864 6/1973 Cason, Jr. et al. .
3,741,321 6/1973 Slover, Jr. et al. .
3,744,580 7/1973 Crow .
3,771,611 11/1973 Omura et al. .
3,866,695 2/1975 Jackson .
3,897,837 8/1975 Peterson .
3,907,048 9/1975 Gray .
3,923,324 12/1975 Cruickshank et al. .
3,948,575 4/1976 Rosser .
3,977,481 8/1976 Fisk ..... 175/345 X
3,982,594 9/1976 Berthiaume .
4,000,783 1/1977 Hug .
4,013,325 3/1977 Rear ..... 175/325.3
4,082,373 4/1978 Kellner .
4,102,416 7/1978 Hug .
4,161,223 7/1979 Oelke .
4,182,425 1/1980 Garrett ..... 175/347 X
4,189,012 2/1980 Garrett .
4,226,291 10/1980 Spelts ..... 175/325.3
4,227,586 10/1980 Bassinger ..... 175/346
4,231,437 11/1980 Swersky et al. ..... 175/325.3
4,254,838 3/1981 Barnetche .
4,254,839 3/1981 Schpok et al. .
4,261,426 4/1981 Garrett ..... 175/346 X
4,262,759 4/1981 Young et al. .
4,273,159 6/1981 Bolton et al. .
4,320,929 3/1982 Clark et al. .
4,329,127 5/1982 Tschirky et al. .
4,378,058 3/1983 Allison .
4,398,610 8/1983 Bassinger .
4,428,626 1/1984 Blau et al. ..... 175/325.3 X
4,480,704 11/1984 May et al. .
4,497,384 2/1985 Hart .
4,508,184 4/1985 Hansen ..... 175/346
4,542,797 9/1985 Garrett .
4,548,284 10/1985 Shinn et al. .
4,552,232 11/1985 Frear .
4,561,508 12/1985 Garrett .
4,583,604 4/1986 Greer .
4,709,462 12/1987 Perkin et al. .
4,765,417 8/1988 Perkin et al. .
4,792,000 12/1988 Perkin et al. .
4,793,425 12/1988 White .
5,190,379 3/1993 White ..... 384/246

SEALED BEARING ROLLER REAMER

This is a continuation of co-pending application Ser. No. 08/134,268 filed on Oct. 8, 1993, now abandoned.

FIELD OF THE INVENTION

This invention relates to roller reamers and similar tools for enlarging bore holes and in particular to sealed bearing roller reamers.

BACKGROUND OF THE INVENTION

Reamers for enlarging bore holes drilled for oil wells and mine shafts have been known in the drilling art for many decades. Typically, a reamer includes a central body having three or more roller reamer units mounted at circumferentially spaced intervals around the tool body. The reamer tool is mounted in a string of drill pipe (drill collars) or other rotatable pipe such that the reamer is rotated with the drill pipe through the well bore in order to enlarge the bore. The roller reamer units rollably engage the well bore wall to enlarge the bore as the drill string moves through the hole. Roller reamers are used to roll against the hole wall of an in-gauge hole to reduce the torque of the drill collars against the hole wall of a directionally drilled hole. An example of a roller reamer tool is found in U.S. Pat. No. 3,977,481 of Fisk which discloses three roller reamer units mounted on a tool body. Each roller unit includes a centrally mounted shaft having the roller mounted onto the shaft for rotation therewith. The shaft and roller mount upper and lower thrust bearings and seal rings to seal off an internal region between the shaft and the roller. This internal region is lubricated utilizing a pressure balancing internal piston to maintain lubrication in spite of variations in pressure surrounding the tool.

Another example of such a roller reamer is found in U.S. Pat. No. 4,182,425 of Garrett which discloses in several embodiments roller reamers having a variety of features. These roller reamers are mounted in position on cylindrical bearing blocks which fit in cylindrical recesses in the tool body. The roller reamers include rollers or cutters which are mounted onto a stationary shaft and are held against thrust by a series of ballbearings or, in a different embodiment, by a thrust flange. Additionally, a lubricant is sealed in between the stationary shaft and the rollers. The lubricant may be held in the region between the stationary shaft and the rotating roller or cutter by means of a flexible diaphragm which acts to equalize the pressure within the lubricating region. In order to remove the cylindrical blocks shown in U.S. Pat. No. 4,182,425 it is necessary to place some type of tool in a recess behind the blocks to push them radially outwardly.

U.S. Pat. No. 4,428,626 of Blau discloses a roller reamer tool wherein two roller units are placed along the same axis and held in position by a combination of end bearing blocks and a central retainer pad which includes a jack screw for removal of the pad from its detented position in the body. These are only examples of a large variety of constructions of roller reamers in the prior art.

SUMMARY OF THE INVENTION

This invention relates to a new and improved roller reamer drilling tool design which utilizes three-dimensional rectangular or generally cubic bearing blocks to hold in position roller reamer units wherein the bearing blocks are sized such that a roller reamer unit can be installed simply and as a unit to facilitate initial installation and repair. The roller reamer of this invention includes an elongated body having a fluid circulation bore therethrough and having threaded end sections to connect the body to adjoining tubular members of a drill string or other assembly of tubular members. The elongated body has a plurality of roller reamer units mounted therewith. The roller reamer units are positioned circumferentially about the elongated body. For each roller reamer unit, the body includes an axially directed recess, the recess including an axially directed central reamer pocket terminating in upper and lower ends. Upper and lower bearing block pockets are located adjacent to the upper and lower ends of the central reamer pocket and a lock block pocket is positioned adjacent to the upper bearing block pocket. A lower bearing block is mounted in the lower bearing block pocket, the lower bearing block having an axially extending opening therein. Each of the roller reamer units includes a shaft, a substantially cylindrical roller or cutter mounted over the shaft and rotatable bearing means mounted with the roller and shaft to mount the roller for rotation with respect to the shaft. An upper bearing block has an axially extended opening therein. The shaft includes a lower end which extends downwardly into the lower bearing block and an upper end which is fixedly mounted in the axially extending opening in the upper bearing block. The upper bearing block pocket is substantially cubic in configuration and has a width greater than the outer diameter of the roller whereby the roller reamer unit is insertable through the upper bearing block pocket into an installed position wherein the lower end of the shaft is inserted in the opening in the lower bearing block and the upper bearing block is positioned in the upper bearing block pocket.

This feature and other features of this invention will be described in more detail in the description of the preferred embodiment to follow. It should be understood that this summary of the invention was intended to describe only some of the features of the invention and that the detailed specification to follow will describe additional features.

DETAILED DESCRIPTION OF PREFERRED EMBODIMENT

Figure 1:
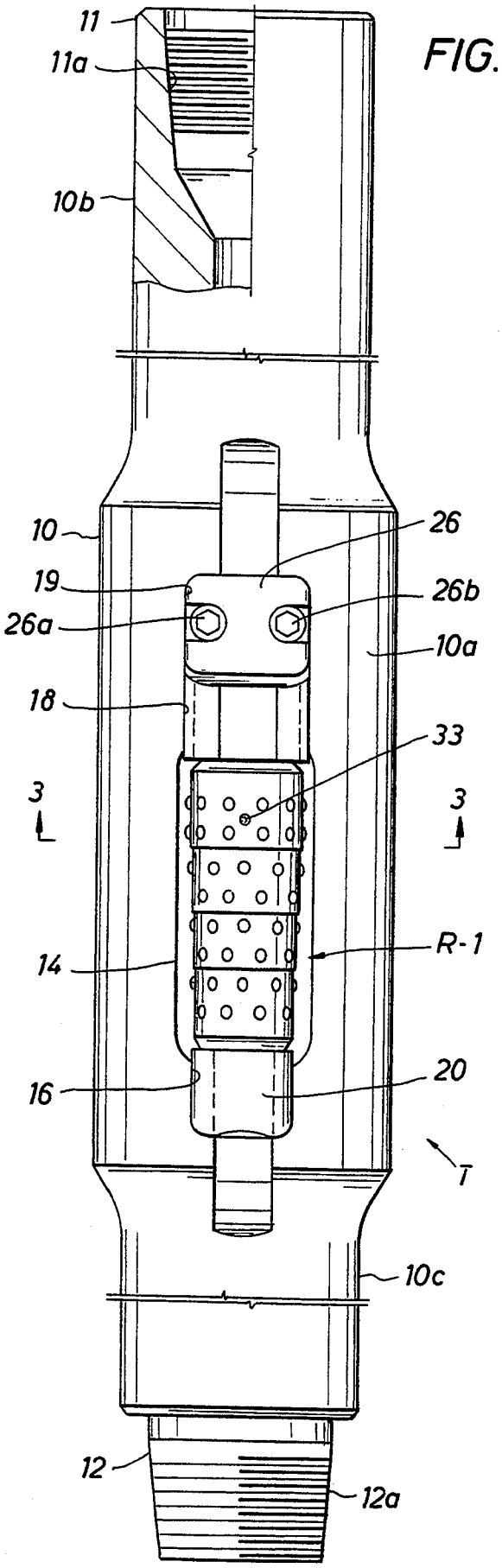
FIG. 1 is a side view of the roller reamer tool of the preferred embodiment of this invention illustrating one of the roller reamer units.

Referring to the drawings, the letter T generally designates the roller reamer tool of the preferred embodiment of this invention. The roller reamer tool T includes a generally cylindrical, elongated body 10, which includes a constant diameter, cylindrical section **10*a* and a reduced diameter upper section 10*b* and a reduced diameter lower section 10*c*. The reduced diameter upper section 10*b*** terminates a "box" end portion 11 having a female thread section 11*a* commonly used in oil well drilling tool designs. The lower reduced diameter section 10*c* terminates in a "pin" end 12 having external threads 12*a* which cooperate with the internal or female threads 11*a* to mount the roller reamer tool T in an oil well drill string or other string of pipe for insertion into a bore hole, which may be a bore hole in an oil well or any other bore hole such as a mining bore hole. The body 10 has an internal, constant diameter bore generally designated as B through which fluids such as drilling fluid flows during oil well drilling operations, as is well-known in the art.

Figure 2:
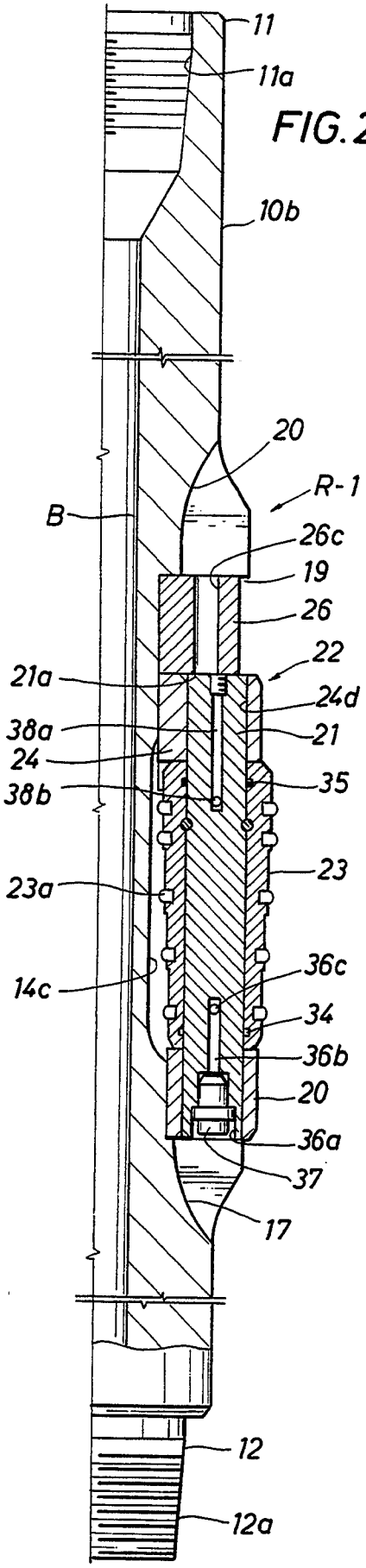
FIG. 2 is a sectional view taken along the center line of the tool through the illustrated roller reamer unit.
Figure 3:
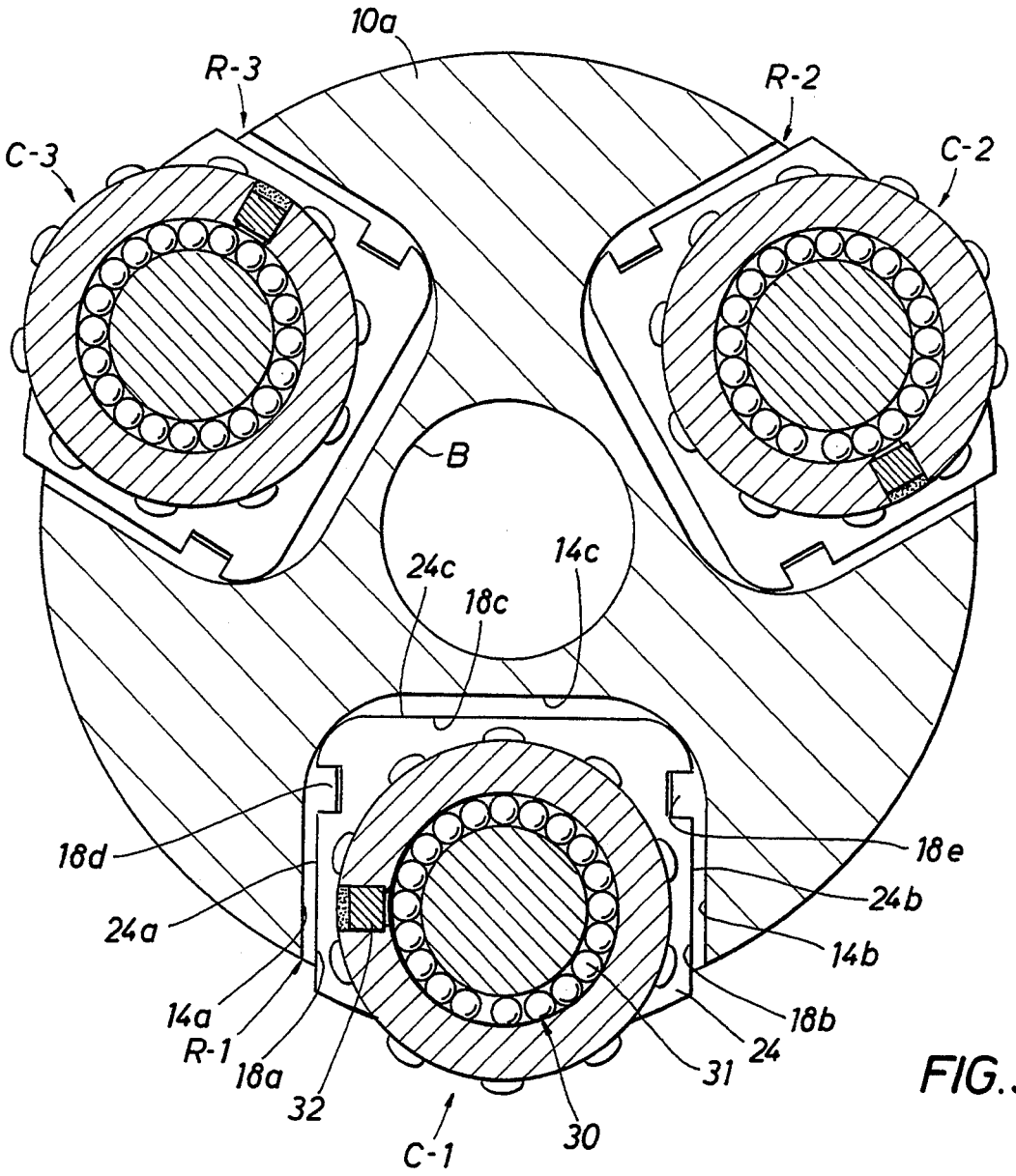
FIG. 3 is a sectional view taken along line 3—3 of FIG. 1 to illustrate the mounting of the roller reamer unit in the upper bearing block.

The central body section 10*a* includes a plurality of circumferentially spaced axially directed recesses such as the recess R-1 illustrated in FIGS. 1 and 2. As illustrated in FIG. 3, there are a series of three recesses generally designated as R-1, R-2 and R-3 which are circumferentially positioned in the central body portion 10*a* of the tool T. The recesses R-1, R-2 and R-3 are circumferentially spaced at 120° intervals and, each of the recesses are R-1, R-2 and R-3 receives therein a roller assembly C-1, C-2 and C-3, respectively.

The elongated, axially-directed recess R-1 includes a central reamer pocket 14. The central reamer pocket is generally rectangular and is formed by side faces 14*a* and 14*b* and bottom surface 14*c*. The width of the central reamer pocket, that is the distance between side faces 14*a* and 14*b* is greater than the outer diameter of the roller unit C-1 to be mounted therein. A lower generally cubic bearing block pocket 16 is machined into the central tool body 10*a* below (to the right in FIG. 1) of the central reamer pocket 14. The lower bearing block pocket 16 is adjacent to a lower end upwardly tapered recess or slot 17 which tapers upwardly from the bottom surface of the lower bearing block pocket 16 upwardly to the outer surface of the lower end reduced diameter tool section 10*c*.

An upper, generally cubic bearing block pocket 18 is machined into the central tool body section 10*a* adjacent to the central reamer pocket 14. The upper bearing block pocket 18 includes side faces 18*a* and 18*b* and a bottom face 18*c*. Each of the side faces 18*a* and 18*b* include a tang portion 18*d* and 18*e*, respectively, which extend inwardly toward each other. A generally cubic lock block pocket 19 is machined into the central tool section 10*a* above (to the left in FIG. 1) of the upper bearing block pocket 18. An upper end tapered slot or recess 20 extends from the lock block pocket upwardly to the surface of the upper, reduced diameter tool body section 10*b*.

A lower bearing block generally designated as 20 is generally cubic in configuration and is mounted in the lower bearing block pocket 16 in the following manner. The lower bearing block pocket 16 includes tang portions machined in the opposing side faces (not shown) of the pocket. The generally cubic lower bearing block member 20 is driven into an interference fit within the pocket 16. The side faces of the bearing block 20 include grooves which mate against the tang portions in the side faces of the bearing block pocket such that the lower bearing block is held against radially outer movement by the combination of the tang and tang slot fit and the interference fit of the side faces of the bearing block against the side faces of the bearing block pocket. The lower bearing block includes a central opening for receiving the shaft 21 of the roller reamer unit generally designated as 22. The roller reamer unit includes the shaft 21 and the generally cylindrical cutter 23 and the upper bearing block 24.

The shaft or pin 21 is generally cylindrical having a diameter that allows insertion of the shaft into the opening in the lower bearing block 20. A generally cylindrical, hollow roller reamer or cutter 23 is mounted onto the shaft. The roller reamer or cutter 23 includes a plurality of tungsten carbide buttons 23*a* to enhance the wear characteristics of the outer surface of the reamer or cutter 23.

The upper bearing block 24 includes side faces 24*a* and 24*b* and a bottom face 24*c* which mate against corresponding faces 18*a*, 18*b* and 18*c*, respectively, of the upper bearing block recess 18. The width of the upper bearing block, that is the distance between faces 24*a* and 24*b*, is slightly greater than the width of the upper bearing block pocket such that there is an interference fit. And, the upper bearing block includes tang grooves which mate against the tang portions 18*d* and 18*e* in the upper bearing block pocket such that the upper bearing block 24 is mounted into the upper bearing block pocket 18 in an interference fit and the tang portions 18*d* and 18*e* hold the upper bearing block against any radially outwardly movement.

The shaft 21 is welded at its annular end portion 21*a* to the inside wall of the bore 24d in the upper bearing block such that the shaft 21, the upper bearing block 24 and the roller or cutter 23 form a roller unit 22. The roller reamer assemblies C-2 and C-3 are identical to the roller reamer assemblies C-1 just described and need not be discussed individually.

The width of the upper bearing block pocket 18, that is the distance between side faces 18*a* and 18*b* is greater than the outer diameter of the roller or cutter 23 including buttons so that the complete roller reamer unit 22 may be inserted as a unit into the axial recesses such as 14 in body section 10*a*.

A general cubic lock block 26 is mounted within the lock block pocket 19 in order to further fix the position of the shaft 21, upper block 24, roller or cutter 23 and lower block 20. The lock block 26 is not an interference fit and is held in place by cap screws 26*a* and 26*b* which extend threadedly through the lock block 26 into the body 10*a* of the tool. Lock block 26 includes a bore 26*c* extending axially therethrough to facilitate removal.

A rotatable bearing means generally designated as 30 is provided for mounting the roller 23 for rotatable movement with respect to the shaft 21 and to further axially maintain the position of the roller 23. The shaft 21 includes a semi-circular groove which cooperates with an aligned semi-circular groove on the interior cylindrical wall of the roller 23 to provide an annular race to house the plurality of ballbearings generally designated as 31. A radial passageway 32 is machined into the roller to extend between the outer surface of the roller and the combination of semicircular grooves which receive the bearings 31. The purpose of the passageway 32 is to provide for insertion of the bearings after mounting of the roller 23 over the shaft 21. After the bearings are inserted, a plug 33 seals off the passageway 32.

A sealed mount means is provided by O-rings 34 and 35 which are mounted in grooves in the interior wall of the roller 23 in order to provide an annular region between the O-rings 34 and 35 which is sealed off from exposure to outside well fluids. An enlarged interior bore 36*a* is machined into the bottom end of the shaft 21. An axial, smaller diameter bore 36*b* is in fluid communication with the larger terminal bore 36a. A radial bore 36c extends from the axial bore 36b to the outer surface of the shaft 21.

A pressure compensator generally designated as 37 is mounted in the terminal bore portion 36a in order to maintain lubricant in the sealed region between the O-rings 34 and 35 in spite of variations in well pressure outside of the tool body. The pressure compensator may be of several known varieties such as pressure compensators manufactured by either Baker Hughes or Rock Bit International and are thus known in the art.

An axial bore 38a is machined into the upper end of the shaft 21 and is in communication with a radial bore 38b which extends from fluid communication with the axial bore 38a to the outer surface of the shaft 21 in the annular area between the seals 34 and 35. During installation, a supply of lubricant such as grease is attached through a pump line to the upper end of the axial bore 38a. The grease applicator includes a vacuum line in order to pull a vacuum on the region between the annular seals 34 and 35 and also in the area of radial bore 36c and axial bore 36b. After the vacuum is pulled, the vacuum line is shut off by a suitable valve and grease is applied into this interior annular region between the seals 34 and 35 and into the area of the radial bore 36c and axial bore 36b. In this manner, whenever pressure within the seal region between the shaft 21 and roller 23 exceeds pressure outside the tool, the rubber compensator bellows moves outwardly to allow for expansion of the lubricant thus maintaining the region under seal under such conditions. Similarly, when the pressure outside of the tool is greater than the pressure within the interior region between the annular seals 34 and 35, the bellows of the pressure compensator moves inwardly to maintain proper pressure within the seal region so that lubrication of all moving parts is facilitated.

During installation of the roller reamer assembly C-1, the first step is to put in place the lower bearing block 20. This block is in an interference fit within the lower block pocket 16 and is held in position by the tang arrangement previously described. Then, the roller reamer unit generally designated as 22 consisting of the shaft 21, upper bearing block 24 and roller 23 is installed as a unit into the central reamer pocket 14 through the upper bearing block pocket 18. As previously described, the width of the upper bearing block pocket 18 is greater than the outer diameter of the roller 23 such that the shaft 21 of roller unit 22 can be installed through the upper bearing block pocket and driven into position within the bore in the lower bearing block 20. As the entire unit 22 is driven into position, the upper bearing block 24 is driven into an interference fit within the upper bearing block pocket 18 and is held in position by the tang and tang groove arrangement of 18c and 18d. After the upper bearing block 24 is fully installed, the lock block 26 is placed in the lock block pocket 19 and fixed in position through cap screws 26a and 28b. The ability to mount the sealed roller reamer unit 22 as a unit into position on the tool 10 is at the heart of the novelty of this invention. This arrangement allows for efficient initial installation as well as replacement of roller reamer units 22 as necessary for purposes of repair or reconstruction.

Figure 4:
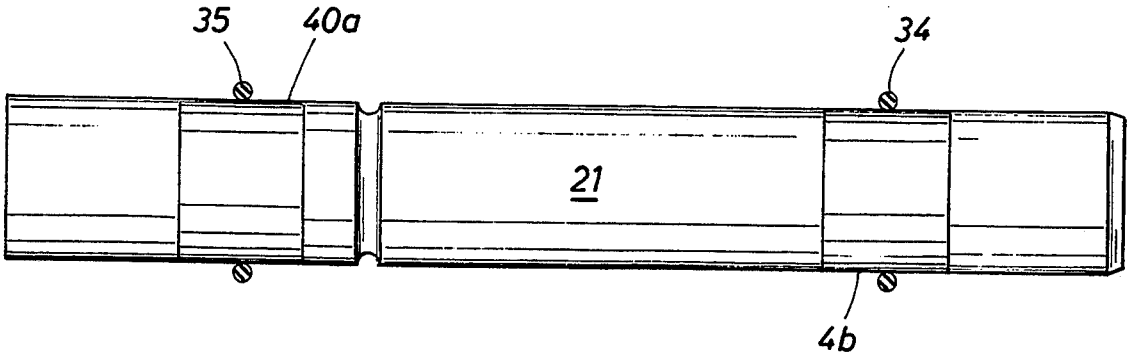
FIG. 4 is a side view of the roller shaft showing the location of hardfacing material used to enhance seal life.

FIG. 4 is a side view of the shaft 21 removed from the assembly drawings of FIGS. 1–3. In FIG. 4, the shaft 21 includes two annular areas 40a and 40b of hardfacing material which is added to the shaft in the annular region to be contacted by seals 34 and 35. The hardfacing may be any added material which provides a highly wear resistant, very smooth or low friction surface to be engaged by the O-ring seals. The use of such hardfacing in this area of high wear will increase the operating life of the O-rings 34 and 35 and thus the tool T. In the preferred embodiment, the hardfacing material is sold under the trademark Armacor M by ATI Company of Luna Niguel, Calif., and is believed to be the subject of U.S. Pat. No. 4,725,512.

Having described the invention above, various modifications of the techniques, procedures, material and equipment will be apparent to those in the art. It is intended that all such variations within the scope and spirit of the appended claims be embraced thereby. For example, the number of roller reamers used on the tool can vary. Also, style of cutters can vary from the button style illustrated to cutters having hard metal welded on the exterior. Further, the shafts may not be aligned with the axis of the tool as illustrated above but, rather, may be at an angle with respect to tool axis.

What is claimed is:

1. A roller reamer drilling tool for enlarging a bore hole in an oil or gas well or other bore holes, comprising:

an elongated body having a fluid circulation bore therethrough and having threaded end sections to connect the body to adjoining tubular members of a drill string or other assembly of tubular members;

said elongated body having a plurality of roller reamer units mounted therewith, said roller reamer units being positioned circumferentially about said elongated body;

for each roller reamer unit, said body having an axially directed recess, said recess including an axially directed central reamer pocket terminating in upper and lower ends, upper and lower bearing block pockets located adjacent to said upper and lower ends, respectively, of said central reamer pocket, and a lock block pocket positioned adjacently to said upper bearing block pocket;

a lower bearing block mounted in said lower bearing block pocket, said lower bearing block having an axially extending opening therein;

each of said roller reamer units including a shaft, a substantially cylindrical roller mounted over said shaft, rotatable bearing means mounting said roller for rotation with respect to said shaft, and an upper bearing block, said upper bearing block having an axially extending opening therein;

said shaft including a lower end which extends downwardly into said lower bearing block opening and an upper end which is fixedly mounted in said axially extending opening of said upper bearing block; and said upper bearing block pocket being substantially cubic in configuration, said upper pocket having width greater than the outer diameter of said roller whereby said roller reamer unit is insertable through said upper bearing block pocket into an installed position wherein said lower end of said shaft is inserted into said opening in said lower bearing block and said upper bearing block is positioned in said upper bearing block pocket.

2. The structure set forth in claim 1, including:

said lock block pocket being substantially rectangular in configuration and having a width greater than the diameter of said roller of said roller reamer units whereby said roller reamer units are insertable through said lock block pocket and said upper bearing block pocket.

3. The structure set forth in claim 1, wherein said rotatable bearing means includes:

sealed mount means for mounting said roller for sealed, rotational movement with respect to said shaft.

4. The structure set forth in claim 3, including:

said sealed mount means including first and second seals mounted between said shaft and said roller to provide a sealed region between said shaft and said roller, said first and second seals being positioned axially apart from each other.

5. The structure set forth in claim 4, including:

a series of ball bearings interposed in rotational engagement with said shaft and said roller to mount said roller for rotational movement with respect to said shaft, said ball bearings being located between said first and second seals.

6. The structure set forth in claim 5, including:

said shaft having a radial bore which extends from the center of the shaft radially to the surface of the shaft in a location between said first and second seals;

said shaft further including an axially directed bore extending from one end of said shaft into fluid communication with said radial bore; and a pressure compensating means for maintaining lubricant under pressure between said shaft and roller and said first and second seals to enhance lubrication thereof under varying pressure conditions.

7. The structure set forth in claim 4, including:

said shaft having first and second areas of hardfacing metal located in alignment with said first and second seals mounted on said roller such that said seals engaged said hardfacing metal in order to increase wear life of said seals.

* * * * *